United States Patent [19]

Mowry, Jr.

[11] 4,420,175

[45] Dec. 13, 1983

[54] COLOR COPY RESISTANT DOCUMENT USING IRREGULAR OUTLINE LETTERS IN A MULTI-VOID BACKGROUND

[75] Inventor: William H. Mowry, Jr., Ionia, N.Y.

[73] Assignee: Burroughs Corporation, Detroit, Mich.

[21] Appl. No.: 218,506

[22] Filed: Dec. 22, 1980

[51] Int. Cl.[3] ..... B42D 15/00

[52] U.S. Cl. ..... 283/93; 283/94; 283/902

[58] Field of Search ..... 283/1 R, 8 B, 8 R, 9 R; 283/94, 93, 902

[56] References Cited

U.S. PATENT DOCUMENTS 3,130,984 4/1964 Fenberg ..... 283/1 R 4,227,719 10/1980 McElligot et al. ..... 283/8 B

FOREIGN PATENT DOCUMENTS 2018197 10/1979 United Kingdom ..... 283/8 B

*Primary Examiner*—Paul A. Bell

*Attorney, Agent, or Firm*—David G. Rasmussen; Kevin R. Peterson; Edmund M. Chung

[57] ABSTRACT

A color-copier resistant document is disclosed which includes a repeated invalidating phrase printed on a document, together with a background tone. In addition to having an overlay camouflage tone printed over the entire surface of the document, each of the invalidating images is formed of irregular, smooth-shaped letters which further advance their hiding characteristics. Overall sizes are suggested for the use of the invalidating word VOID, and stroke sizes for each of the letters are also disclosed.

4 Claims, 3 Drawing Figures

COLOR COPY RESISTANT DOCUMENT USING IRREGULAR OUTLINE LETTERS IN A MULTI-VOID BACKGROUND

BACKGROUND OF THE INVENTION

A. Field of the Invention

This invention relates to color copier resistant documents. More particularly it relates to color copier resistant documents where machine copies made of such documents immediately denote themselves as invalid copies of the document. The indication of invalidity, which is clearly revealed on the copy, is substantially hidden on the original document.

B. Prior Art

In the past, copy-resistant documents such as those disclosed in U.S. Pat. Nos. 4,210,346, 4,227,719 and 4,227,720 were set forth as solutions to the problems created by the advent of color copiers. It is believed well known that documents reproduced by today's color copiers are so close in appearance to their originals that it takes an expert to differentiate between the two. In view of the great potential for harm that such excellent reproductions may have in the world's legal and financial communities, it becomes increasingly important to provide a simple system for differentiating copies of such documents from the original document.

Most of these earlier systems were composed of a single tone cancellation word fitted precisely into a significantly different background tone. Tone, in this instance, is intended to include both percent of area covered by the dots or marks and the distances between said dots or marks. In addition, the cancellation word VOID used was fairly large. For example, suggested sizes for the cancellation word VOID in these earlier systems was in the range of two (2) inches high and six (6) inches long. Thus, a check-sized document included only a single cancellation word. The letters used in the word VOID were composed of broad stroke geometric shapes. The cancellation word VOID and the background combination were then covered by another patterned screen which camouflaged the tonal difference between the word VOID and the background.

Though these previous systems have been useful they had several flaws. The use of the camouflage screen does help to make the word VOID less noticeable, but it is often not as well hidden as one would desire. Also, the large size of the word VOID limits the flexibility of placing illustrations, logo types, check formats, etc. on the document. Further, placing a custom design in the background tone to form a new background tone has produced a document with a satisfactorily hidden VOID word, but where the custom design covers the VOID word, it prevents reproduction of that portion of the VOID word which is covered. Naturally, this interference between the custom design and the cancellation word reduces the effectiveness of the hidden VOID when it appears on the copy of the original document.

BRIEF DESCRIPTION OF THE INVENTION

A. Objects of the Invention

Accordingly, it is an object of the invention to provide an improved copy-resistant document having increased hiding characteristics.

It is another object of the invention to provide an improved copy-resistant document which includes irregular, smooth-shaped letters to form the letters of the cancellation word.

It is another object of the present invention to provide a copy-resistant document which allows increased flexibility in the location of the cancellation phrase on the document.

It is also an object of the present invention to provide a copy-resistant document which repeats the cancellation word along a single path on the document and also has multiple paths over the surface of the entire document.

It is a still further object of the present invention to provide a copy-resistant document on the surface of which is a cancellation word which is reduced in size.

It is still another object of the present invention to provide a copy-resistant document which allows custom designs to be printed on the surface of the document as part of the background wherein the designs do not interfere with the cancellation phrase and its reproduction by a color-copier.

B. Summary of the Invention

In the preferred embodiment of this invention, the letters of the VOID word previously used on the surface of a copy-resistant document have been altered by changing the shape of each of the letters from regular geometric shapes to irregular smooth shaped outline letters. Also the letters of the cancellation phrase (VOID word) have been reduced in size, so that they may be repeated along a single path as well as applying multiple paths of such VOID words. This increased multiplicity of cancellation clauses enables increased flexibility as to the positioning of the VOID words. Further, this increased flexibility enables the printing on the documents of custom designs which designs do not interfere with the cancellation phrases.

BRIEF DESCRIPTION OF THE SEVERAL VIEWS OF THE DRAWING

The foregoing objects and the summary will be more readily understood when read in conjunctionn with the accompanying drawings, in which.

DETAILED DESCRIPTION OF THE INVENTION

Figure 1:
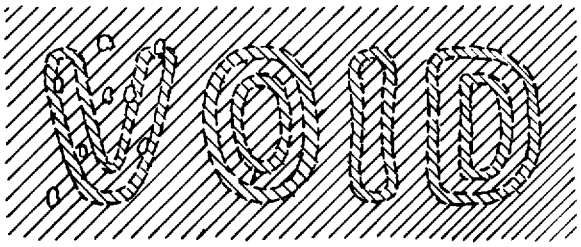
FIG. 1 pictorially illustrates a blown up portion of a printed document using the smaller, irregular, smooth-shaped letters of the VOID word printed in a step and repeat pattern on the face of said document and covered by a moire camouflage overprinting.

The following detailed description will be more easily comprehended when it is read with reference to the foregoing drawings in which like reference characters symbolize corresponding parts.

FIG. 1 illustrates the improved covering capability of the moire camouflage overlay when the irregular, smooth-shaped letters proposed by this disclosure are utilized.

Cross hatching indicates the areas of the less than full tone VOID image. Cross hatching at an orthorgonal orientation indicates the less than full tone background image. The camouflage is shown as the absence of cross hatching.

Figure 2:
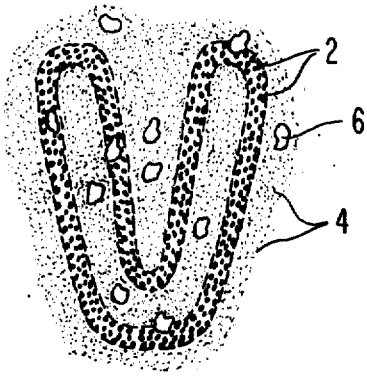
FIG. 2 is an expanded view of one letter of the VOID word of FIG. 1 pictorially illustrating the less than full tone VOID and background images overlaid with camouflage.

FIG. 2 provides a more detailed description of the less than full tone VOID and background images of FIG. 1. The camouflage is also shown. The less than full tone image of large dots making up the VOID images are shown by designator 2. The dots are resolvable by a color copier. The less than full tone image of small dots making up the background images are shown by designator 4. These dots are too small to be resolved by a color copier. The camouflage 6 is shown as the absence of large dots in the VOID image and small dots in the background image. The outlining of the letter is in a dashed line. The dashed line doesn't exist but only indicates the interface of the big dots of the less than full tone VOID image and the little dots of the less than full tone background.

Figure 3:
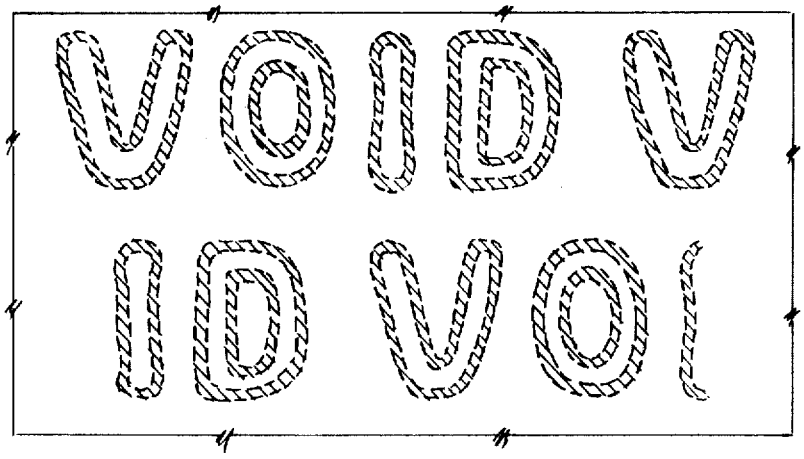
FIG. 3 illustrates a portion of a document as shown in FIGS. 1 and 2 after it has been copied on a color copier.

FIG. 3 shows the repetitive use of the VOID word, 10, 12, 14 etc. Each of the letters of the word VOID are shown in an irregular, smooth-shaped outline configuration. It is readily seen that these letters have been changed from their usual regular geometric block type shape.

Also, the cancellation clause is reduced to approximately one (1) inch in height by three and one quarter (3.25) inches long. These changes have resulted in at least two improvements over present systems:

1. The irregular, smooth-shaped letters are more difficult to observe on printed documents than the present large block letters used for the word VOID. Though the degree of the difference varies with different camouflage patterns, there is a significant improvement with each of the selected camouflage patterns. Further, VOID words formed by irregularly shaped outline letters of about 0.1 inches stroke thickness were found to be difficult for the human eye to find on the original, but sufficiently bold for highly visible images on color copies.

2. The reduced size of the VOID word and the step and repeat pattern also allows for more flexibility in locating the cancellation phrase on the printed document. By creating a step and repeat pattern of the VOID word on a photographic negative the cancellation phrase may be placed on the printed document in a location that permits custom designs to be part of the background without interfering with the cancellation phrase and its reproduction by a copier.

The letter size and the word size disclosed in FIG. 2 result from a compromise between a stroke size for best hiding characteristics and a size that is considered best for copying. The one-tenth (0.1) inch stroke width proved effective and gave rise to the basic letter and word sizes that are illustrated herein.

In summary, it is believed that the following three areas have been set forth herein and are worthy of consideration. They are:

1. Use of smaller, irregularly shaped, outline letters in a single or step and repeat background with a variety of camouflage patterns and colors of ink.

2. Use of various camouflage patterns with the irregularly shaped outline letters, since these characters minimize moire effects in the various pattern combinations.

3. Use of irregularly shaped outline letters to avoid moire patterns and to more effectively conceal the letters in the overall camouflage pattern on printed documents.

It will be understood from the foregoing description that various modifications and changes may be made in the preferred embodiment of the present invention without departing from its true spirit. It is intended that this description is for purposes of illustration only and should not be construed in a limiting sense. The scope of this invention should be limited only by the langugage of the following claims.

What is claimed is:

1. A document for deterring a nefarious reproduction thereof upon a color copier comprising:

a substrate;

a first tone invalidating image printed in a certain area on said substrate, said invalidating image including at least one outlined character, the outline of said character being at the inner and outer edges of said character, the outlining being a less than full tone image;

a less than full tone colored background printed on the remaining areas of said substrate, said background including the space inside said inner outline edge of said character and the space between said inner and outer outline edges;

a second tone camouflage image printed in an overlay fashion over said colored background and said first tone image, wherein said first tone invalidating image formed of said at least one outlined character is substantially invisible to the human eye when viewed in conjunction with said second tone camouflage image and said background, but which said first one invalidating image formed of said at least one outlined character is readily apparent upon a reproduction of said document by said color copier.

2. The document as set forth in claim 1 wherein the outline of said at least one outlined character is formed of approximately one-tenth inch stroke thickness, said stroke thickness being the width of the character outline edges, the outline of said at least one outlined character being substantially continuous upon the reproduction of said document by said color copier.

3. The document as set forth in claim 1 or 2 wherein said second tone camouflage image is formed in a herring-bone design.

4. The document as set forth in claim 1 or 2 wherein said at least one outlined character is imprinted in a step and repeat pattern on the surface of said substrate.

* * * * *